US005209532A

United States Patent [19]

Nakamura et al.

[11] Patent Number: 5,209,532

[45] Date of Patent: May 11, 1993

[54] DOOR LOCK DEVICE

[75] Inventors: Hitoshi Nakamura; Tatsuyuki Takaishi, both of Yokohama, Japan

[73] Assignee: Ohi Seisakusho Co., Ltd., Yokohama, Japan

[21] Appl. No.: 876,019

[22] Filed: Apr. 28, 1992

[30] Foreign Application Priority Data

Apr. 30, 1991 [JP] Japan ..... 3-38695[U]

[51] Int. Cl.[5] ..... E05C 3/26

[52] U.S. Cl. ..... 292/216; 292/340

[58] Field of Search ..... 292/216, 340, DIG. 41, 292/DIG. 43

[56] References Cited

U.S. PATENT DOCUMENTS

| | | | |
|---|---|---|---|
| 3,331,624 | 7/1967 | Pugh | 292/216 |
| 4,097,078 | 6/1978 | Tack et al. | 292/216 |
| 4,172,768 | 10/1979 | Cerdan | 292/216 |
| 4,941,696 | 7/1990 | Yamada et al. | 292/216 X |
| 4,981,313 | 1/1991 | Makamura | 292/340 |
| 5,050,917 | 9/1991 | Hamada et al. | 292/340 |
| 5,064,229 | 11/1991 | Hamada et al. | 292/216 |

FOREIGN PATENT DOCUMENTS

| | | |
|---|---|---|
| 1086305 | 10/1967 | United Kingdom . |
| 1229228 | 4/1971 | United Kingdom . |

*Primary Examiner*—Richard E. Moore

*Attorney, Agent, or Firm*—Foley & Lardner

[57] ABSTRACT

A door lock device includes a striker secured to a vehicle body and a latch plate installed on a vehicle door. The striker has a base portion fixed on the vehicle body, first and second leg portions extending from the base portion, a bridge portion extending between and interconnecting the first and second leg portions, and a projection portion which extends from the bridge portion and extends on the outboard side of the first leg portion. The latch member has first and second engaging portions defining therebetween a recess portion in which the first leg portion of the striker is receivable. The first engaging portion is arranged to overlap the projection portion and the second engaging portion is arranged to overlap the bridge portion.

11 Claims, 2 Drawing Sheets

DOOR LOCK DEVICE

BACKGROUND OF THE INVENTION

1. Field of the Invention

The present invention relates in general to an automotive door lock device, and more particularly to a striker of an automotive door lock device.

2. Description of the Prior Art

JP-A (Patent) 61-172974 discloses a conventional striker of an automotive door lock device. This striker comprises a base plate which is to be fixed to a motor vehicle body, and a generally U-shaped engaging portion which is to be engaged with a latch plate of a door lock device proper installed on a vehicle door. The engaging portion monolithic in construction comprises first and second leg portions which are generally perpendicular to the base plate and generally parallel to each other, and a bridge portion which extends between and interconnects the first and second leg portions and is generally parallel to the base plate. Under a condition in which the striker is fixed to the vehicle body, the first and second leg portions are respectively positioned on the outboard and inboard sides, as viewed from a longitudinal axis of the vehicle body.

The latch plate is generally C-shaped and comprises first and second engaging portions which define a recess portion therebetween. Under a condition in which the door lock device proper is installed on the door, the first and second engaging portions are respectively positioned on the outboard and inboard sides.

Under a condition in which the door is latched to the vehicle body, the latch plate is engaged with the striker in such a manner that the first leg portion of the striker is received in the recess portion of the latch plate.

When a tensile load is applied to the door lock device so as to pull the door lock device proper and the striker apart in a fore-and-aft direction of the vehicle, the second engaging portion of the latch plate is brought into abutment with the bridge portion of the striker so as to maintain the locked engagement between the door lock device proper and the striker.

However, the above-mentioned door lock device has the following drawbacks.

Upon receiving the load, the first engaging portion of the latch plate is not brought into abutment at its major surface with the striker. That is, the load is concentrated on the second engaging portion. Thus, it is necessary to increase strength of the latch plate for sustaining the load. For this purpose, for example, it is necessary to increase thickness or width of the second engaging portion of the latch plate. However, this leads to enlarging the size of the door lock device, and increasing the weight and production cost of the same.

SUMMARY OF THE INVENTION

It is therefore an object of the present invention to provide an improved striker of a vehicle door lock device, which striker can increase the strength of the device, without increasing the thickness and width of a latch plate of the device, against a tensile load added to the device in a fore-and-aft direction of a vehicle body.

According to the present invention, there is provided a door lock device for latching a door to a fixed member having an opening adapted to be closed by the door, the door lock device including: a striker secured to one of the fixed member and the door, the striker having a base portion, first and second leg portions extending from the base portion, a bridge portion extending between and interconnecting the first and second leg portions, and a projection portion which extends from the bridge portion and extends on the outboard side of one of the first and second leg portions; and a latch member which is pivotally secured to the other of the fixed member and the door, the latch member having first and second engaging portions defining therebetween a recess portion in which one of the first and second leg portions of the striker is receivable, the first engaging portion being arranged to overlap the projection portion and the second engaging portion being arranged to overlap the bridge portion.

DESCRIPTION OF THE PREFERRED EMBODIMENTS

Figure 1:
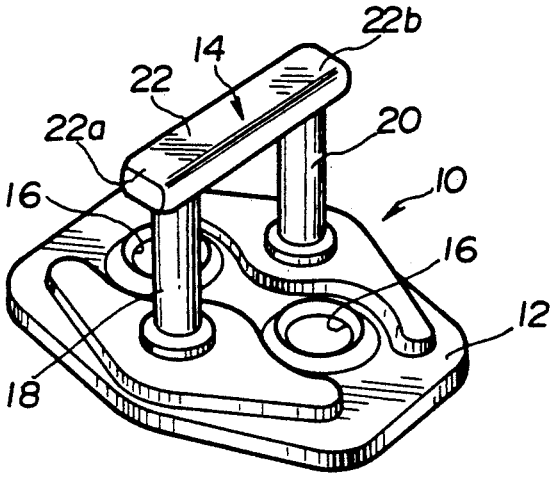
FIG. 1 is a perspective view of a striker according to the present invention.
Figure 2:
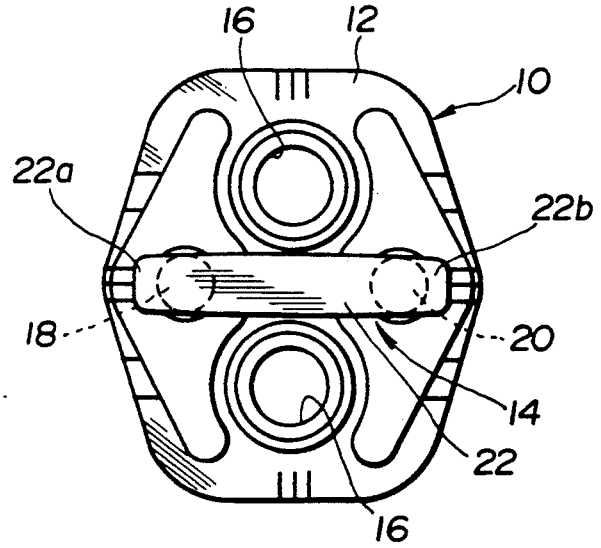
FIG. 2 is a plan view of the striker.
Figure 3:
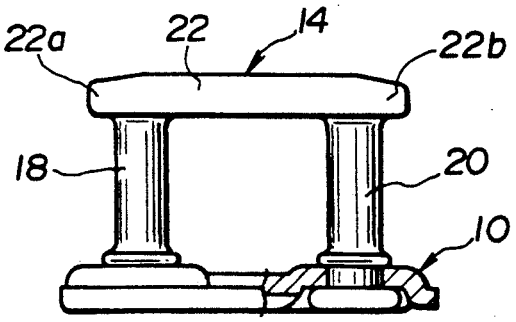
FIG. 3 is a side view of the striker.

Referring to FIGS. 1 to 3, there is provided a striker 10 of a vehicle door lock device according to the present invention. The striker 10 comprises a metal base plate 12 and a generally U-shaped engaging portion 14. The base plate 12 formed by pressing has two circular through holes 16. The base plate 12 is to be fixed to a vehicle body (not shown) through two bolts (not shown) passing through the holes 16 so as to be disposed on a predetermined position of a periphery of a door opening. The engaging portion 14 of the striker 10, which is monolithic in construction, comprises first and second leg portions 18 and 20, and a bridge portion 22 which extends between and interconnects the first and second leg portions 18 and 20. The first and second leg portions 18 and 20 are secured at base portions thereof to the base plate 12 and arranged to be perpendicular to the base plate 12. The bridge portion 22 is arranged to be parallel to the base plate 12.

According to the present invention, the engaging portion 14 further comprises two projection portions **22*a* and 22*b* which project from the bridge portion 22. The projection portions 22*a* and 22*b* are monolithically formed on the engaging portion 14 by forging. The projection portions 22*a* and 22*b* are chamfered, as illustrated. Furthermore, it is optional to coat the projection portions 22*a* and 22*b*** with a plastic film.

Figure 4:
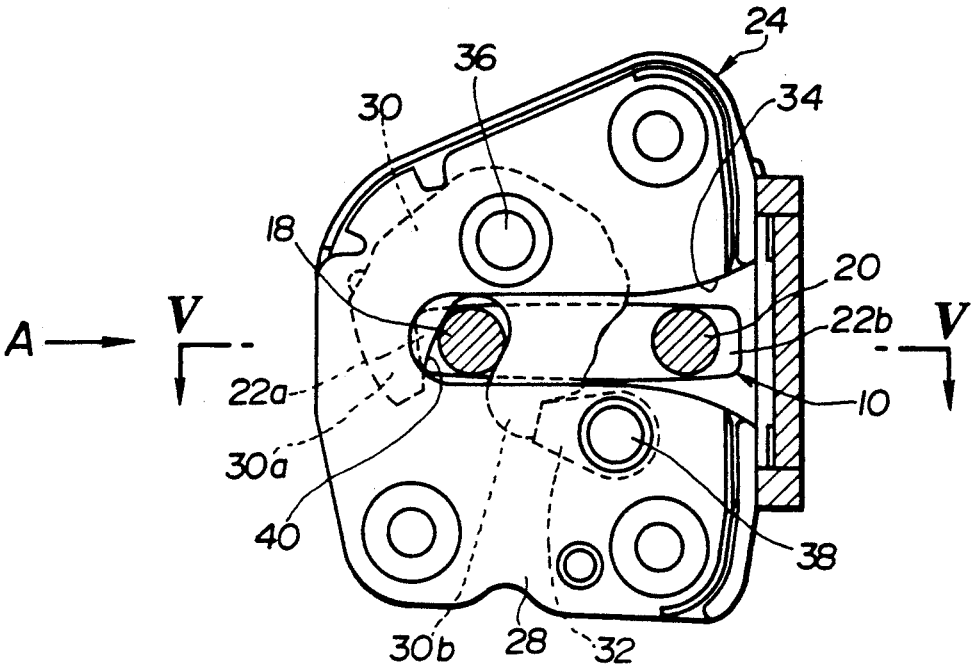
FIG. 4 is a rear elevational view of a left door lock device having the striker, showing a condition in which the striker is engaged with a latch plate of the device.

Referring to FIG. 4, there is provided a door lock device for a left door (not shown) of a motor vehicle. The door lock device comprises a door lock device proper 24 and the striker 10 according to the present invention. The door lock device proper 24 is installed on a rear end portion of the left door and positioned so a to be engaged with the striker 10, thereby latching the door to the vehicle body.

Figure 5:
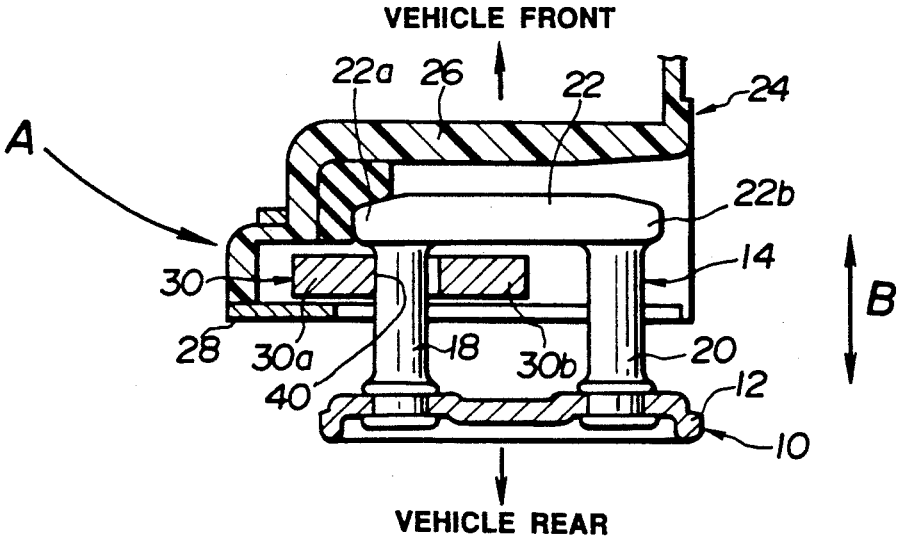
FIG. 5 is a sectional view which is taken along the line V—V of FIG. 4.

As is seen from FIGS. 4 and 5, the door lock device proper 24 comprises a plastic body 26, a metal cover plate 28, a latch plate 30 and a pawl 32. The cover plate 28 is formed with a notch 34 for receiving therein the engaging portion 14 of the striker 10. The latch plate 30 and the pawl 32 are respectively pivotally secured to the cover plate 28 and the plastic body 26 through pivot shafts 36 and 38.

The latch plate 30 which is generally C-shaped has first and second engaging portion 30*a* and 30*b* which define a recess portion 40 therebetween.

Upon closing the left door, the door lock device proper 24 is moved toward the striker 10, as is shown by an arrow "A" in FIG. 4 or 5. With this, the first leg portion 18 of the striker 10 is received in the recess portion 40 of the latch plate 30. Then, the latch plate 30 is pressed by the striker 10 so as to rotate the latch plate 30 in a clockwise direction in FIG. 4. With this, the first engaging portion 30*a* of the latch plate 30 is brought into engagement at an end portion thereof with the pawl 32 to achieve a half-latched condition. Then, if the latch plate 30 is further pressed by the striker 10 to rotate the latch plate 30, the second engaging portion 30*b* of the latch plate 30 is brought into engagement at an end portion thereof with the pawl 32 to achieve a full-latched condition which is shown in FIG. 4. With this, the left door is fully latched to the vehicle body.

As is clearly seen from FIG. 5, the projection portion 22*a* on the outboard side overlaps the first engaging portion 30*a* of the latch plate 30 in a fore-and-aft direction of the vehicle body.

When a tensile load is applied, as shown by an arrow "B" in FIG. 5, to the door lock device in the fore-and-aft direction so as to pull the door lock device proper 24 and the striker 10 apart, the first and second engaging portions 30*a* and 30*b* of the latch plate 30 are respectively brought into abutment with the projection portion 22*a* and the bridge portion 22 of the striker 10 so as to sustain the load and to maintain a locked engagement between the door lock device proper 24 and the striker 10.

Thus, as compared with the aforementioned conventional striker, the load is not concentrated on the second engaging portion 30*b* of the latch plate 30, but is received by both of the first and second engaging portions 30*a* and 30*b* of the latch plate 30. With this, strength of the door lock device against the load is increased, without increasing the thickness and width of the latch plate 30.

It is optional to secure the striker 10 and the door lock device proper 24 to the door and the vehicle body, respectively.

What is claimed is:

1. A door lock device for latching a door to a fixed member having an opening adapted to be closed by the door, said door lock device comprising:

a striker secured to one of the fixed member and the door, said striker having a base portion, first and second leg portions extending from the base portion, a bridge portion extending between and interconnecting the first and second leg portions, and a projection portion which extends from the bridge portion and extends on the outboard side of the first leg portion by a length which is substantially the same as one half the thickness of the first leg portion in a longitudinal direction of the bridge portion, the bridge portion and the projection portion having substantially rectangular sections, respectively, which are arranged perpendicular to the longitudinal direction of the bridge portion; and a latch member which is pivotally secured to the other of the fixed member and the door, said latch member having first and second engaging portions defining therebetween a recess portion in which the first leg portion of said striker is receivable, the first engaging portion being arranged to overlap the projection portion and the second engaging portion being arranged to overlap said bridge portion;

wherein said projection portion is monolithically formed on said striker by forging.

2. A door lock device according to claim 1, wherein said striker is secured to a vehicle body, and said latch member is pivotally secured to a vehicle door.

3. A door lock device according to claim 1, wherein the first and second engaging portions of the latch member respectively overlap the projection portion and the bridge portion in a fore-and-aft direction of a vehicle body.

4. A door lock device according to claim 1, wherein the projection portion extends from the bridge portion in a direction which is substantially perpendicular to the first and second leg portions.

5. A door lock device according to claim 1, wherein said projection portion is chamfered.

6. A door lock device according to claim 1, wherein the width of said bridge portion is greater than its thickness.

7. A door lock device according to claim 1, wherein said first leg portion has a diameter substantially the same as the width of said bridge portion; and wherein the diameter of said first leg portion is greater than the thickness of said bridge portion.

8. A door lock device according to claim 1, wherein the width and the thickness of said bridge portion are in the ratio of about 3 to about 2.

9. A door lock device according to claim 1, wherein the first and second leg portions are cylindrical in shape.

10. A door lock device according to claim 1, wherein said striker is axially symmetric with respect to an axis which is arranged along the first and second leg portions and lies on a center of the bridge portion.

11. A door lock device according to claim 1, wherein said bridge portion has a substantially uniform thickness and a substantially uniform width; and wherein said projection portion has a thickness greater than one half the thickness of the bridge portion and a width substantially the same as the width of the bridge portion.

* * * * *